US006578660B2

(12) United States Patent
Taylor

(10) Patent No.: US 6,578,660 B2
(45) Date of Patent: Jun. 17, 2003

(54) SPEAKER ENCLOSURE VENTURI EXPANDER

(76) Inventor: Ronald K. Taylor, 4465 13th Ter., Miami, FL (US) 33134

( * ) Notice: Subject to any disclaimer, the term of this patent is extended or adjusted under 35 U.S.C. 154(b) by 0 days.

(21) Appl. No.: 09/883,885

(22) Filed: Jun. 18, 2001

(65) Prior Publication Data

US 2002/0011379 A1 Jan. 31, 2002

Related U.S. Application Data

(60) Provisional application No. 60/213,057, filed on Jun. 21, 2000.

(51) Int. Cl.[7] ..... G10K 13/00

(52) U.S. Cl. ..... 181/155; 181/154

(58) Field of Search ..... 181/156, 153, 181/155, 154, 199, 148, 151

(56) References Cited

U.S. PATENT DOCUMENTS

| | | | | | |
|---|---|---|---|---|---|
| 4,146,744 | A | * | 3/1979 | Veranth | 181/146 |
| 4,348,549 | A | * | 9/1982 | Berlant | 181/152 |
| 4,439,644 | A | * | 3/1984 | Bruney, III | 181/151 |
| 4,882,760 | A | * | 11/1989 | Yee | 181/199 |
| 5,204,501 | A | * | 4/1993 | Tsao | 181/156 |
| 5,436,977 | A | * | 7/1995 | Sato | 181/156 |
| 5,749,433 | A | * | 5/1998 | Jackson | 181/156 |

* cited by examiner

*Primary Examiner*—Kim Lockett
(74) *Attorney, Agent, or Firm*—Joel I. Rosenblatt

(57) ABSTRACT

A venturi expander is mounted on a speaker enclosure to receive the rearward-propagated sound waves and to extend the propagation path. The venturi expander's reflective sides direct the rearward sound to the sides or top or bottom of the speaker enclosure to produce a reflected sound surrounding the speaker enclosure and producing sound to the sides of the speaker substantially as projected from the front of the speaker.

29 Claims, 6 Drawing Sheets

SPEAKER ENCLOSURE VENTURI EXPANDER

CROSS REFERENCE TO RELATED APPLICATIONS

This application is related to provisional patent application No. 60/213,057, filed Jun. 21, 2000 and claims the benefit of the filing date of that application.

FIELD OF THE INVENTION

This invention is in the field of speaker systems and in particular to speaker enclosures intended for operation at the lower or bass frequencies of the audio range.

BACKGROUND

Speaker enclosures have been used as long as sound was reproduced by a conventional electro-mechanical speaker. Enclosures were used as a structural support to hold the speaker in place and to baffle or reduce the effect of noises or out of phase sound waves, created by the operation of the speaker and which interfered with the reproduction of the a true sound intended to be reproduced. In connection with speakers used to produce $bass_{13}$ tones at the low frequency end of the audible range, for example from 150 Hz and below the speaker enclosure had to be made large enough so pressures produced with the creation of the sound frequency waves, did not interfere with the extended movement of the speaker cone at those lower frequencies.

As background, speaker enclosures were built with baffles to extend the path for backwardly projected out of phase audio waves emanating from the rear of the speaker, to prevent these waves from interfering with the forward directed waves from the front of the speaker, because of the production of undesirable elements for example standing waves, air turbulence port noise, whistling, and port chuffing. In the case of speaker enclosures at the lower frequency ranges, the enclosure size had to be large enough to accommodate the pressures created at these lower frequencies which prevented the reduction in the size of the enclosure and prevented the enclosure from being made small so that pressure could not be properly vented without producing the before mentioned undesirable sound effects.

Many attempts have been made to solve the problems created by low frequency enclosures for the purpose of making a smaller size enclosure which do not suffer sound degradation associated with higher internal pressures or backwardly directed waves. For example, U.S. Pat. Nos. 5,517,573 and 4,196,792 show ways of using ports to vent the enclosure so low frequency sounds may be reproduced and whistling diminished and so the size of the speaker enclosure could be made smaller. However, these devices were limited as the use of ports to release the speaker internal pressures while effectively managing the standing wave problem from the backwardly projected waves, prevented a reduction in the size of the enclosure. In connection with the projected sound, a large portion of the sound energy in the backwardly projected sound was lost as the object was to reduce the effect of the speaker on the air mass inside the speaker enclosure and the efficiency of the speaker was reduced as the energy associated with the backwardly projected sound wave were not effectively utilized to enhance the sound produced by the speakers. While U.S. Pat. No. 4,231,445 made an attempt to disperse the backwardly or rearwardly projected sound waves, relative to the forward projected sound waves from the front of the speaker, the rearward sound waves were not utilized to project the sound around the speaker enclosure or to extend the sound path relative to the length of the sound waves at the lower frequency range to prevent or minimize degradation of the total sound from the speaker.

SUMMARY OF THE INVENTION

The venturi expander invention disclosed herein in its preferred embodiments and according to the principles of the disclosed invention, overcomes the problems of the prior art devices in removing or relieving the pressures in the speaker enclosure which impede the movement of the speaker cone at low frequencies, for example at 150 Hz. and below, without the accompanying distortion of port noise such as whistling or port chuffing. The venturi expander operates with improved venting; reducing the internal pressure of the enclosure, and permits the volume and size of the enclosure to be reduced. Speaker size reduction using the venturi expander can be accomplished without sacrificing an extended audio path to disperse the backwardly or rearwardly projected out of phase sound waves so their reflections do not create cancellation by the mixing of out of phase rearward sound waves with the forward projected sound waves from the front of the speaker.

The efficiency of the speaker enclosure is enhanced by the venturi expander by providing a path for dispersing the backwardly or rearward projected sound waves, in an extended path through surfaces which direct the movement of the sound waves out of the enclosure in a compound path transverse to and through bell ports placed in the speaker enclosure, extending the path of the sound waves by reflection in the transverse direction while the propagation of the sound waves is through the bell ports. An air port tube in line with the rear of the speaker and opposed to the rear of the speaker is vented at the rear wall of the enclosure, providing a tube like path for relieving the pressure built up in the enclosure around the speaker. The sound waves propagating in a compound path out of the bell ports are in a pattern that causes reflection of the sound waves from the sides, top and bottom of the speaker enclosure and residual sound waves via air port tube exhaust. These sound waves contribute to a 360-degree pattern when combined with the sound waves projecting from the front of the speaker.

The compound sound propagation path is through the speaker enclosure rear wall port opening and the inlet to the bell ports and through the bell ports to the bell port opening, and projecting the rearward sound waves at an angle to the forward sound waves projected from the front of the speaker. The effect is that of a surround sound or 360 degree sound, so for example, in a live performance musicians playing at the sides or rear of an instrument amplified by a venturi expander design speaker enclosure may hear the sound waves from that instrument as do those musicians sitting in the path of the forward projected sound waves.

The bell ports, according to the principles of the venturi expander and as shown in a preferred embodiment of the invention, receive the sound waves emitted from the rear of the speaker and reflected from the interior side walls of the speaker enclosure and exterior of air port tube, and are arranged to reflect the sound back and forth against the rear exterior wall of the speaker enclosure and the sides of the bell ports. In a preferred embodiment, the sides of the bell port are stepped with the distance between the sides of the bell port and the rear wall of the speaker increasing in the direction of propagation from the bell port inlet to the bell port opening. In this way the reflected waves will move obliquely with a direction component transverse to the direct propagation path through the bell port, extending the propagation path and reducing the effect out of phase sound waves would have on the forward propagated waves from the front of the speaker. At the same time, the energy in the rearward-propagated sound waves is not lost or reduced to produce the effect of 360-degree sound wave dispersion.

In accordance with the principles of the invention and the preferred embodiments disclosed, the air port tube extending through the rear wall of the enclosure and through the venturi expander, is in line with, and opposed to the rear of the speaker and vents the higher than ambient air pressure out from the enclosure. The tube may be of a varying size and is placed opposed to the rear of the speaker to effectively vent the internal pressure created by the operation of the speaker. The small size of the air port tube inlet port relative to the cross sectional area of the speaker at the inlet port, allows the flow of air and the release of pressure without interfering with the backwardly projected sound waves reflected internally from the walls of the speaker and the exterior radial wall of the air port tube and out the bell ports. The air tube cross sectional area may be reduced where the size of the speaker is made smaller and may be blocked where the size of the speaker does no create pressure levels impeding the movement of the speaker cone. In this way, the air port tube may be adjusted to accommodate any size speakers.

DESCRIPTION OF THE INVENTION

The invention according to its disclosed inventive principles, is now shown and described with reference to its preferred embodiments and to the Figures where the same numerals are used to identify the same or similar parts with the same or similar functions.

Figure 1:
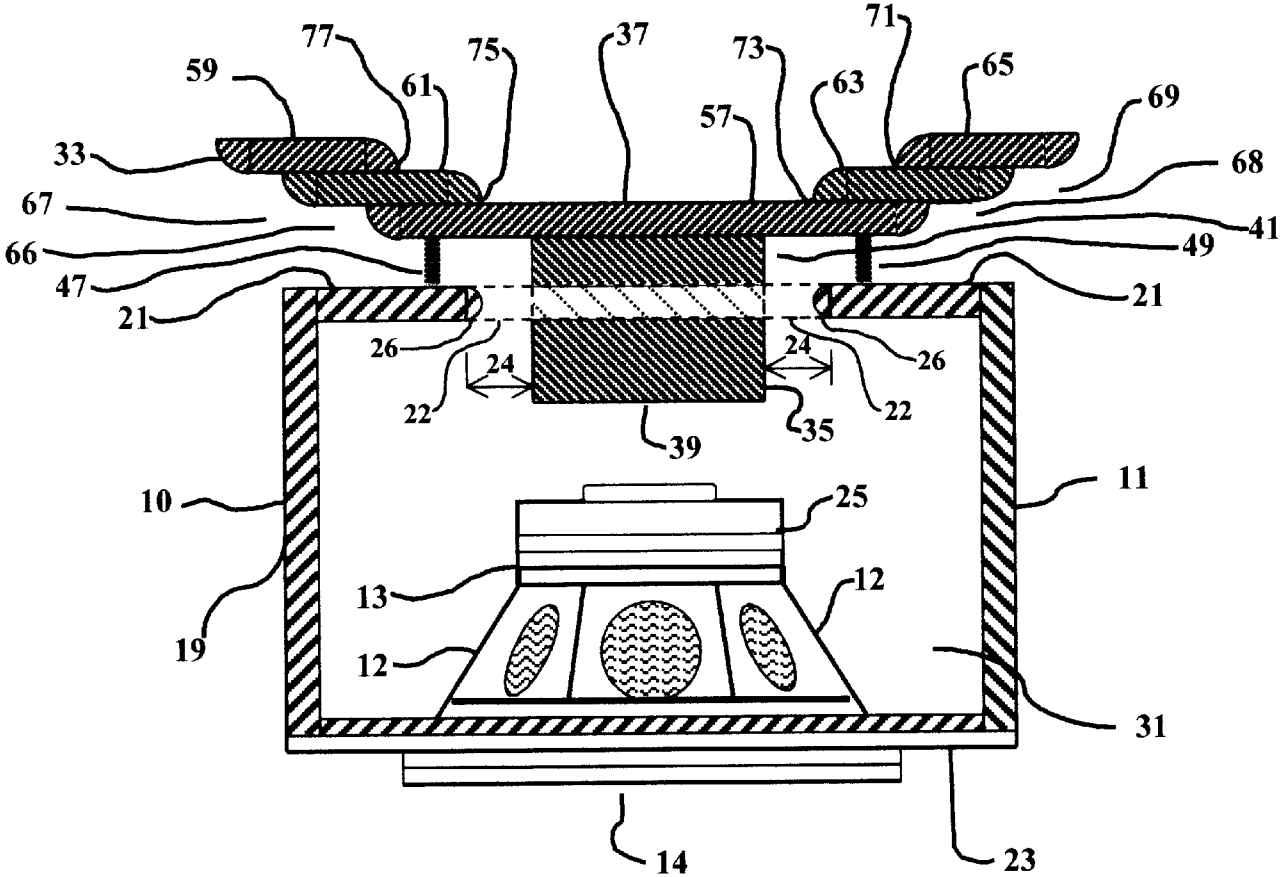
FIG. 1 shows the interior of the speaker enclosure in a top view down into the enclosure with the speaker top removed and with the venturi expander attached to the rear wall of the speaker enclosure.

FIG. 1 in a top view generally shows a preferred embodiment as a speaker enclosure 10. The enclosure is shown in a top view looking into the enclosure with the top cover removed. The speaker enclosure 10 as seen in this top view, is made of front wall 23, side walls 11 and 19 and rear wall 21. Projecting through the front wall 23 is the front or forward propagation direction 14 of speaker 13. The venturi expander is shown generally by numeral 33 and is mounted to the rear wall 21 by means of mounting pins 47 and 49. Passing through rear wall 21 is an air port tube 35 extending into the speaker enclosure 31, with an inlet port 39 opposed to the rear of speaker 13, shown generally by numerals 12 and 25, and a flared portion 41 terminating in outlet port 37. Surrounding the air port tube 35 is a circular port opening through rear wall 21 shown by numeral 22 and having a radial width shown by numerals 24.

Figure 1A:
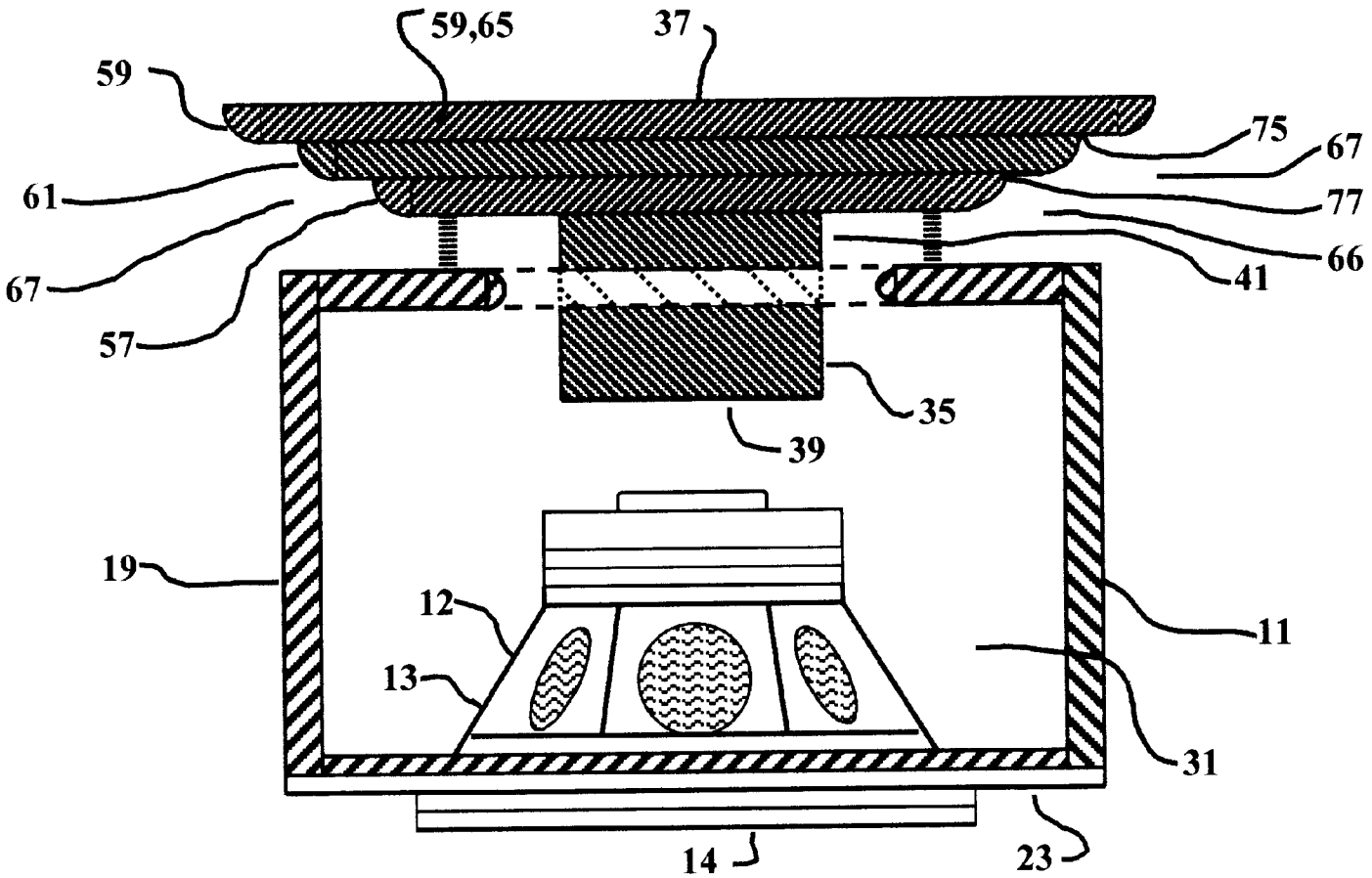
FIG. 1*a* shows the interior of the speaker enclosure, as shown in FIG. 1. and with circular stepped walls of the venturi expander forming a continuous bell port, corresponding to the rear view of FIG. 2*a*.
Figure 2:
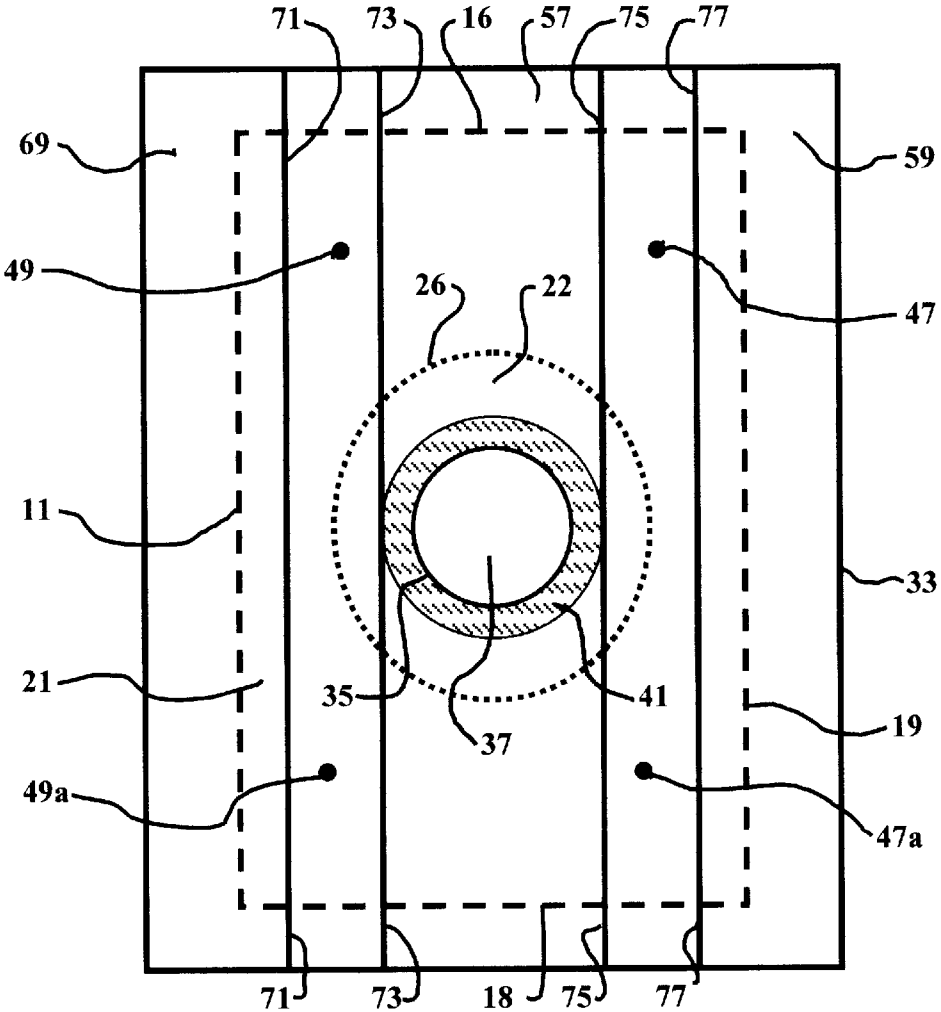
FIG. 2 Shows the venturi expander in a rear view with the rear wall and the opening in the rear wall through which sound waves may propagate from the rear of the speaker to the venturi expander.
Figure 2A:
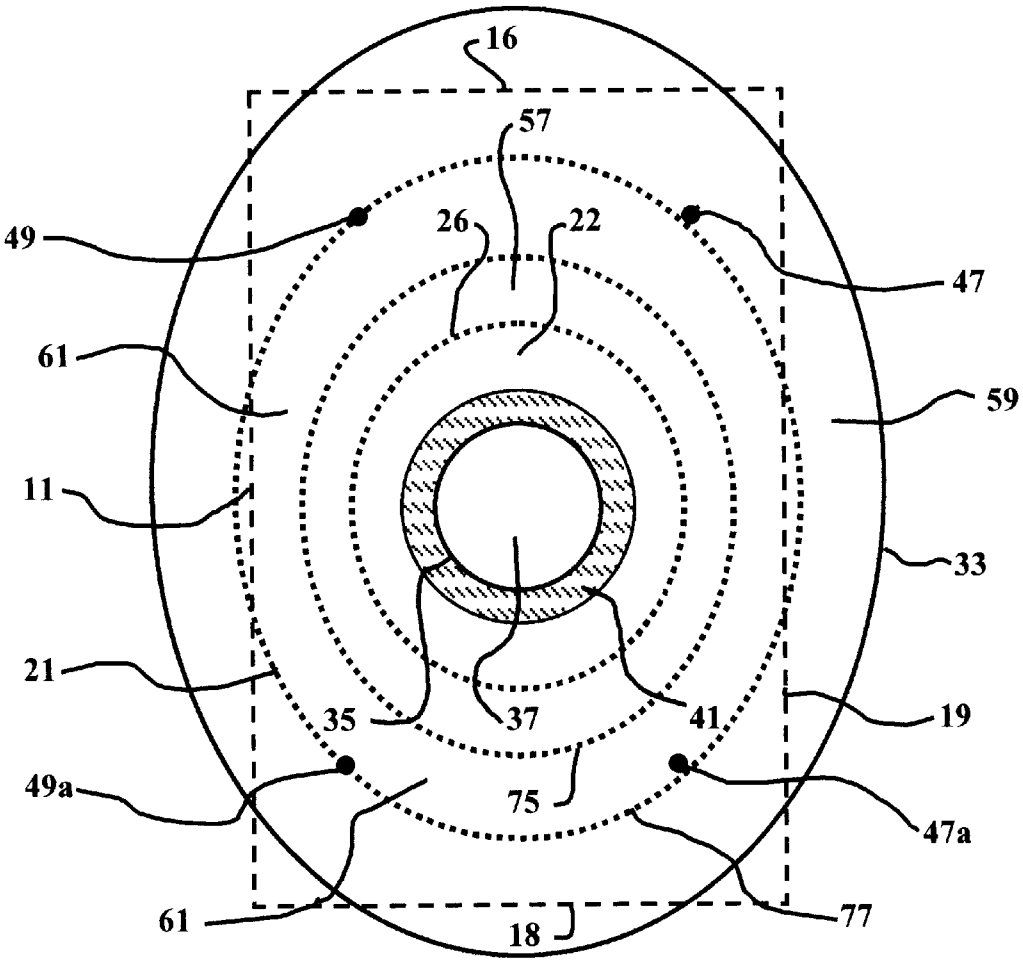
FIG. 2*a* shows the venturi expander in a rear view as shown in FIG. 2, with circular stepped walls of the venturi expander forming a continuous bell port, corresponding to the top view of FIG. 1*a*.
Figure 4:
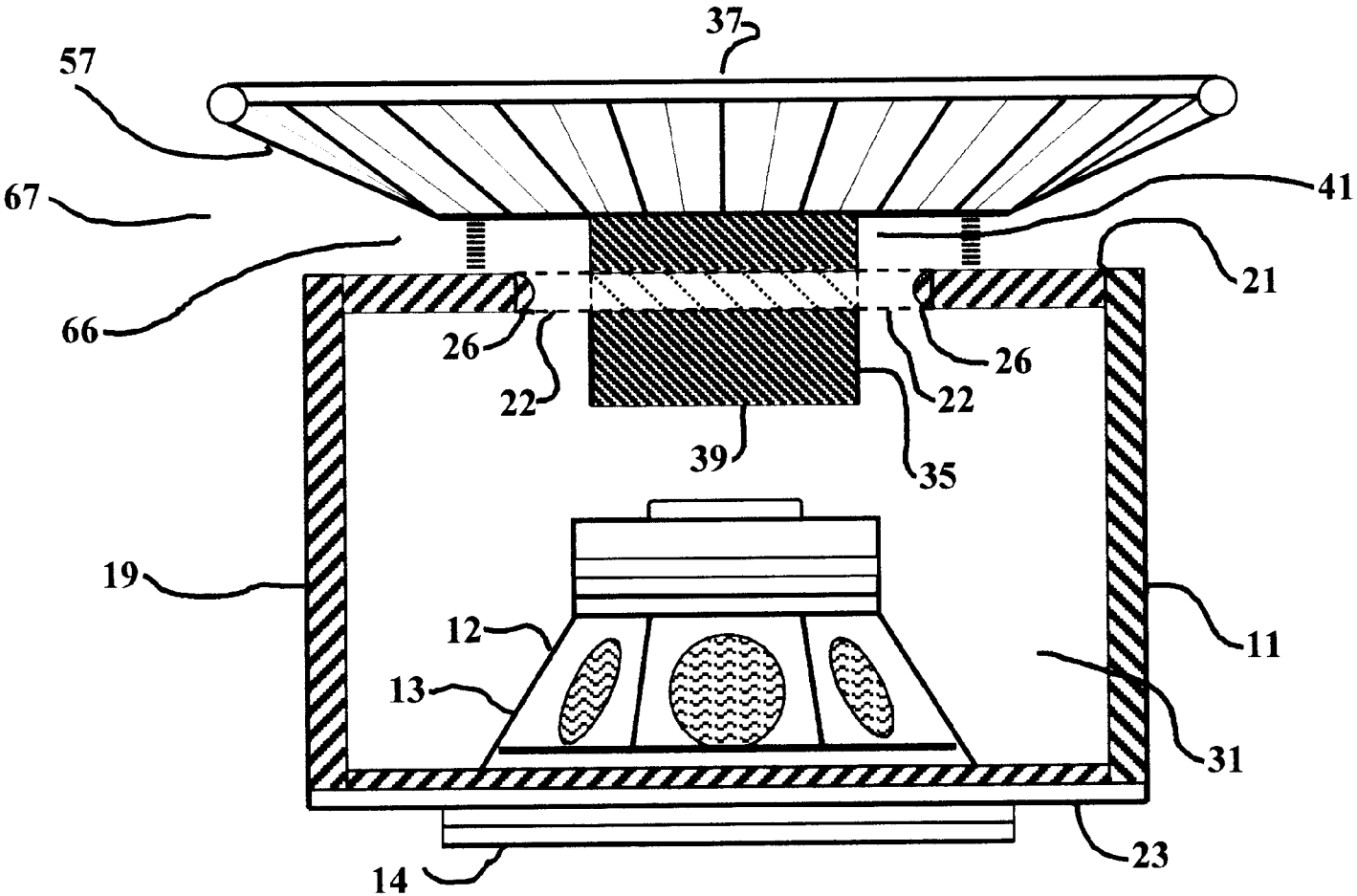
FIG. 4 shows the venturi expander with a circular port bell and with the wall of the circular bell port being made continuous

As may be seen in FIG. 1, the venturi expander includes one or more bell ports shown as bell ports 66 and 68, with respective bell port openings to ambient 67 and 69, located to receive sound from the rear 12, of speaker 13 propagated toward the venturi expander, through circular port 22 opening in rear wall 21. An air port tube 35 shown in a preferred embodiment as in line and opposed to the rear 25 of the speaker 13, extends through rear wall 21 and terminates in a flared section 41 opening 37 to ambient. The inlet of the air port tube is proximate the rear 12 of speaker 13 to place the inlet in an area of higher pressure relative to ambient. The bell ports 66 and 68, as shown in a preferred embodiment, may be formed of stepped sides as shown in FIG. 1 or in a continuous side as shown in FIG. 4, arranged so the stepped side or the continuous side, are increasingly displaced from the rear wall 21 in the direction of direct sound propagation from the rear of the speaker 13 through the bell port inlet, formed in a preferred embodiment as shown in FIG. 1, by the circular port opening 22, the rear wall 21 and the reflective surface 57 and the bell port comprising the bell port reflective surfaces 57, 59, 61, 63 and 65 and the bell port openings 67 and 69, creating or defining a passage of increasing width in the direction of the bell port openings 67 and 69. Bell port walls are shown by numerals 59 and 61 in stepped relation with each other and with bell wall 57 and forming bell port 66 with bell port opening 67, and by bell port walls 63 and 65 in stepped relation with each other and with bell wall 57 and forming bell port 68 with bell port opening 69. As shown in FIG. 4, a continuous bell port wall 57 may be used instead of the stepped walls as described. As would be understood by those skilled in the art, the bell port walls as shown by numerals 59, 61, 63, and 65, may extend beyond the side walls 11 and 19 and the top 16 and bottom 18, of speaker enclosure 10, as shown in FIGS. 2 and 2*a*, or be coextensive with, or less than the dimensions of these speaker wall 11, and 19 or top 16 or bottom 18. The bell port walls 59, 61, 57, 63, and 65, may be arranged relative to each other in a coaxial fashion as shown in FIGS. 1*a* and 2*a*, or be one continuous wall as shown in FIG. 4, or may be varied in any other suitable way, consistent with the principles of the disclosed invention.

The circular port opening 22 is shown in phantom in rear wall 21 with radial width 24 extending from the outer wall of the air port tube 35 to the outer radial edge of the circular port 22. As would be understood by those skilled in the art, the circular port opening 22, in the propagation path of the sound waves from rear 12 of speaker 13, to the venturi expander 33, may be varied in shape and size and be made in one continuous opening or may be discontinuous sections in the same radial distance from the axis of the air port tube 35 or in a plurality of continuous openings centrally or non centrally placed in the rear wall 21 of speaker enclosure 10.

The seams where the stepped walls over lap are shown by numerals 71, 73, 75 and 77. As shown in FIGS. 1*a* and 2*a*, where the stepped walls are concentric or coaxial, the seams are shown as circular.

The rear of the venturi expander is shown in FIG. 2. in which the same numerals as in other Figures show the same or similar parts, with rear wall 21 of the speaker shown in phantom. Mounting pins 47, 47*a* and 49 and 49*a* are shown supporting the venturi expander 33 on speaker enclosure rear wall 21. The outlet port 37 of the air port tube 35 is shown with its flared portion 41. Surrounding the air port tube 35 is the circular port 22 in rear wall 21 and extending radially from the air port tube 35 to the outer edge 26 of the circular port 22, in the radial width shown by numeral 24 in FIG. 1.

Referring to FIG. 1, the bell ports 66 and 68 are shown with the stepped walls 57 and 63 and 65 for bell port 68 and it bell port opening 69 to ambient and 59 and 61 for bell port 66 and its bell port opening 67 to ambient and extending away from the rear wall to define an increasing opening in the direction of direct propagation of the sound from the interior 31 of the speaker through the circular port 22 and to the stepped walls of the bell ports 67 and 68. As would be apparent to one skill in the art, the stepped walls may be circular, or coaxial or arranged in any other suitable arrangement which achieves the effect of a widening sound port in the direction of propagation. In a preferred embodiment, the stepped walls overlap each other in circular seams as shown in FIG. 2 and FIG. 2*a*, the venturi expander bell ports may extend beyond side walls 11 and 19 and top 16 and 18, all shown in phantom view.

A preferred embodiment as shown in FIG. 1*a*. and FIG. 2*a*, shows a continuous circular bell port instead of the two separate bell ports 67 and 69 as shown in FIG. 1. The outer most stepped circular wall is shown by numeral 59, the intermediate stepped circular wall is shown by numerals 61, and the overlapping seams by numerals 77 and 75. A top view of the venturi expander as shown in FIG. 1. is as shown in FIG. 1*a* with circular walls as shown in FIG. 2*a*. As would be known to those skilled in the art, the shape or size of the reflecting walls and the shape and size of the opening shown, may be varied without departing from the principles of disclosed invention. In particular, the bell ports may be constructed with reflecting surfaces separate from the surfaces of the rear wall, without departing from the disclosed inventive principles.

As would be understood by one skilled in the art, the bell ports 66 and 68 as shown in FIG. 1 and FIG. 2 or the circulars bell port as shown in FIGS. 1*a*, and 2*a*, may be varied by sectioning the continuous bell port of FIGS. 1*a* and 2*a* or making the outer stepped wall extend beyond or coextensive with the top, bottom and sides of the speaker enclosure side walls 11 and 19 and top and bottom 16 and 18, or of a smaller dimension or change the shape or location of the circular port 22. In accordance with the principles of the invention, the cross section of the air port tube 35, the distance between the stepped walls of the bell ports 67, 69, and the size and shape placement of the port 22 in rear wall 21, may be varied from that shown in a preferred embodiment to derive the best performance of the venturi expander consistent with the size of the speaker and the speaker enclosure.

As seen in FIGS. 1 and 2, the outermost stepped wall of the bell ports 66, 68, extend beyond the side walls 11 and 19 of the speaker enclosure. Depending on the performance desired from the venturi expander, the bell ports as formed by the stepped walls, may be extended beyond the top 16 and bottom 18 of the speaker, as explained above.

Figure 3:
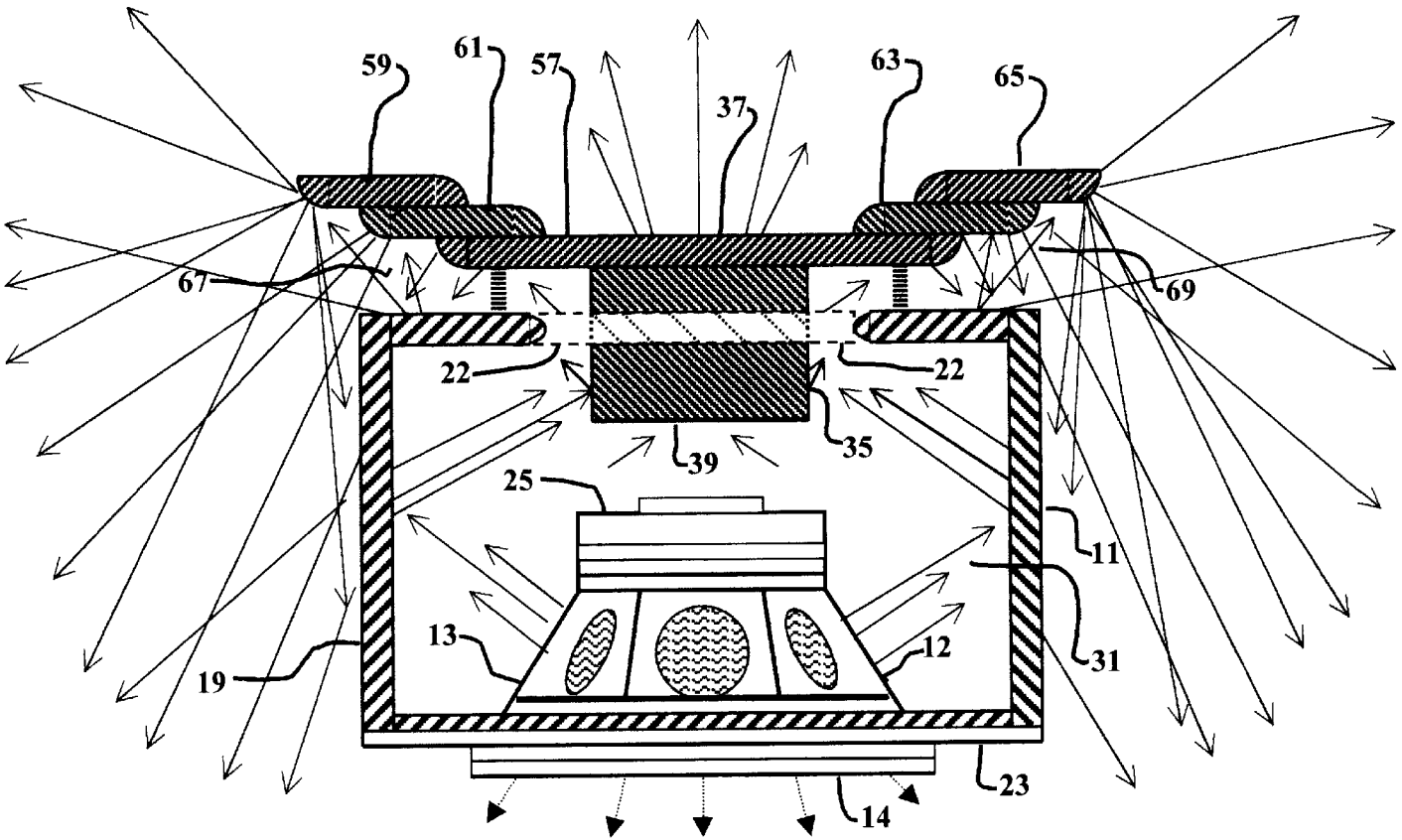
FIG. 3 shows the venturi expander is schematic form to show the propagation paths of sound from the rear of the speaker to the bell ports and to ambient from the port bell openings.

The operation of the venturi expander as shown in preferred embodiments above or as may be varied by one skilled in the art is explained with reference to FIG. 3, wherein the venturi expander is shown in schematic form showing the sound propagation scheme of the venturi expander. In the schematic of FIG. 3, the same numerals are used to show the same or similar parts as in all other drawings. The arrows shown without numerals represent the sound energy in the form of acoustic sound waves produced by speaker 13 from its front 14 in the form of forward propagated sound waves and to the rear from its back 12 in the form of rear propagated sound waves. Sound waves propagated from the rear 12 of speaker 13, are in a path toward the rear wall 21 along air port tube 35 and reflected from the sides 11 and 19. The air port tube 35 placed in line and opposed to speaker 13, provides an exhaust for the higher than ambient air pressure produced by the movement of the cone of speaker 13 and serves as an exhaust for that pressure as would be well known to those skilled in the art. With the exhaust of the air through air, port tube 35 is residual sound, which is passed to ambient through air port tube outlet port 37.

The sound directed to the sides and along the sides of air port tube 35, propagates out the circular port opening, as shown in a preferred embodiment 22 and to the stepped reflecting surfaces 57, 63 and 65 and 57, 61 and 59 and out to ambient through respective bell port openings 67 and 69. These reflecting surfaces cause the sound waves to move in a reflective path in an oblique path with a directional element transverse to the direct sound propagation path from the bell port inlets through the bell ports 66, 68, to the bell port opening and out of out bell ports openings 69 and 67, As the sound waves propagate through the widening path of the port bells shown in FIGS. 1, 1*a*, 3, and 4, the sound propagation pattern of the sound waves is spread about the bell port at its openings 67 and 68 into ambient causing the sound waves to be directed out from the speaker, with a portion of the sound energy being directed to, and reflected off the sides 11, 19, or in the case where the venturi expander extends beyond the top 16 or bottom 18, of the speaker enclosure, as shown in FIGS. 1*a* and 2*a*, with a portion of the sound energy being directed to and reflected off the top or the bottom of the speaker enclosure. In this way, the sound from the speaker sides produces the effect of sound radiating around the speaker with reference to the front to back direction of the speaker enclosure from the front wall 23 to the rear wall 21.

The propagation path of the sound waves from the rear 12 of speaker 13 is extended or elongated by reflection within the speaker enclosure 31, by the interior of the side walls 11 and 19 and the exterior of air port tube 35 and by reflection within the bell ports 66 and 68 which alter the direct sound propagation path and extend it by directing the sound waves obliquely to the direct sound propagation path with a directional element transverse to the direct sound propagation path by reflection between the reflective surfaces of the bell ports, as shown in FIG. 3. As the sound waves propagate, through the widening path of the port bells, 66 and 68, the sound waves are caused to move more slowly, reducing the potential for interference with the forward propagating sound waves from the front 14 of speaker 13. The sound waves propagating out of bell port outlets 67 and 69, are dispersed obliquely to, or directly with, or sideways from, the front to back direction of the speaker enclosure, or the direction of sound propagation in a forward direction from the front of the speaker, and substantially around the speaker enclosure, for example radiating substantially about the axis of the air port tube 35 and radiating towards the front of the speaker enclosure and to the rear of the speaker enclosure as shown in FIG. 3, by propagation paths from the bell ports 66, 68, or from the bell ports to and from the sides 11, 19, or top 16 or bottom 18, of the speaker enclosure 10 and by the residual sound from the air port vent tube 35. In this way, the object of spreading the sound about the speaker enclosure radially outward from the sides of the speaker enclosure is so musicians sitting at the side of the amplified sound of another musician, can hear the same music or sounds as those in front of the speaker enclosure.

Various adjustments may be made to the shape of the port bells, the air port tube, the size of the ports used in the propagation path and the distances between the elements without departing from the principles of the invention. For example, as shown in FIG. 4, the circular port bell shown in FIGS. 1*a*, and 2*a*, may be a continuous wall instead of a stepped wall. As would be known to those skilled in the art, the sound patterns may varied by varying the configuration, size and spacing of the various parts of the venturi expander, without departing from the principles of the invention as shown and disclosed.

I claim:

1. A speaker enclosure venturi expander, comprising, a speaker enclosure having a front wall, rear wall, and a side wall, respectively;

a speaker having a speaker front and a speaker rear;

said speaker mounted in said front wall of said speaker enclosure with said speaker front opening to ambient and said speaker rear inside said enclosure;

at least one bell port, with a bell port inlet opposed to said speaker rear, and with bell port opening to ambient; and a plurality of sound reflecting surfaces in said bell port placed with at least two of said sound reflecting surfaces arranged relative to each other and to said bell port inlet, to reflect sound in a plurality of oblique sound propagation paths from said bell port inlet to said bell port opening.

2. The speaker enclosure venturi expander of claim 1, wherein said plurality of sound reflecting surfaces in said bell port are placed relative to each other to reflect sound in respective oblique sound propagation paths, in opposed directions relative to each other.

3. The speaker enclosure venturi expander of claim 2, wherein said bell port, said bell port inlet and said bell port opening, include a direct propagation path from said bell port inlet to said bell port opening and wherein said plurality of respective oblique sound propagation paths, in opposed directions relative to each other, cross said direct propagation path.

4. The speaker enclosure venturi expander of claim 1, wherein said bell port opening comprises at least one bell port opening reflective surface and said at least one bell port opening reflective surface is arranged relative to said side wall to reflect sound in a side propagation path from said at least one bell port opening to said side wall and from said side wall to ambient.

5. The speaker enclosure of claim 1, comprising an air port tube, said air port tube including a longitudinal axis through said air port tube; with an inlet of said air port tube, opposed to said speaker rear and with an outlet of said air port tube proximate said rear wall and with the longitudinal axis of said air port tube passing through said speaker rear.

6. The speaker enclosure of claim 5, wherein said air port tube inlet is placed within an area of higher pressure area relative to ambient, and arranged with said inlet located to exhaust said high pressure area.

7. The speaker enclosure of claim 5, wherein said inlet of said air port tube includes an adjustable opening.

8. A speaker enclosure venturi expander, comprising, a speaker enclosure having a front wall, rear wall, and a side wall, respectively; and with said rear wall joined to said side wall;

a speaker having a speaker front and a speaker rear;

said speaker mounted in said front wall of said speaker enclosure with said speaker front opening to ambient and said speaker rear inside said enclosure;

at least one bell port, with a bell port inlet opposed to said speaker rear, and with bell port opening to ambient;

a plurality of sound reflecting surfaces in said bell port placed with at least two of said sound reflecting surfaces arranged relative to each other and to said bell port inlet, to reflect sound in a plurality of oblique sound propagation paths from said bell port inlet to said bell port opening;

said rear wall including a rear wall port opening between said speaker enclosure and said bell port; and said plurality of reflecting surfaces include said rear wall.

9. The speaker enclosure venturi expander of claim 8, wherein said inlet port includes said rear wall port opening.

10. The speaker enclosure venturi expander claim 8, wherein said bell port is proximate said rear wall joined to said side wall.

11. The speaker enclosure venturi expander of claim 10, wherein at least two of said sound reflecting surfaces are stepped relative to each other to increase the length of at least one of said oblique sound propagation paths for one respective stepped reflective surface relative to the length of another of said oblique sound propagation paths.

12. The speaker enclosure venturi expander of claim 9, wherein said plurality of reflective surfaces comprises at least one continuous reflective surface.

13. A speaker enclosure comprising, a front wall means, a side wall means and a rear wall means;

a speaker means for propagating sound in a forward propagation path from said front wall means and in a rear propagation path into said speaker enclosure;

a bell port means, including bell port opening means and bell port receiving means for receiving said sound from said speaker means in said rear propagation path and for directing said sound in a plurality of oblique sound propagation paths in opposed directions relative to each other, to said bell port opening means.

14. The speaker enclosure of claim 13, wherein said bell port means, said bell port inlet means and said bell port opening means comprises a direct sound propagation path means from said bell port inlet means to said bell port opening means and wherein said means for directing said sound in a plurality of oblique sound propagation paths in opposed directions relative to each other comprises means for directing said sound in a sound propagation path crossing said direct sound propagation path and said bell port means includes said rear wall means.

15. The speaker enclosure of claim 13, wherein said bell port means comprises reflective means in a stepped relationship for increasing a length of at least one of said oblique sound propagation paths relative to another of said oblique sound propagation paths.

16. The speaker enclosure of claim 13, wherein said reflective means comprises continuous reflecting means for increasing said a length of at least one of said oblique sound propagation paths relative to another of said oblique sound propagation paths.

17. The speaker enclosure of claim 13, including top wall means or bottom wall means and wherein bell port opening means includes means for directing sound to ambient from said top wall means or said bottom wall means, obliquely to said forward propagation path.

18. The speaker enclosure of claim 13, comprising air tube vent means for exhausting a high pressure are relative to ambient, and, wherein said air tube vent means includes an inlet means and means for varying said inlet means and means for establishing a sound propagation path from said speaker enclosure to said ambient.

19. The speaker enclosure of claim 13, wherein said side wall means includes side wall reflecting means for propagating sound in said rear propagation path in a plurality of straight paths to said bell port receiving means.

20. The speaker enclosure of claim 18, wherein said side wall means and said air tube vent means include means for propagating sound in said rear propagation path in a plurality of straight paths to said bell port receiving means.

21. A speaker enclosure venturi expander, comprising, a speaker enclosure having a front wall, rear wall, and a side wall, respectively;

a speaker having a speaker front and a speaker rear;

said speaker mounted in said front wall of said speaker enclosure with said speaker front opening to ambient and said speaker rear inside said enclosure;

at least one bell port, with a bell port inlet opposed to said speaker rear, and with bell port opening to ambient; and a plurality of sound reflecting surfaces in said bell port placed with at least two of sound reflecting surfaces arranged relative to each other and to said bell port inlet, to reflect sound in a plurality of oblique sound propagation paths from said bell port inlet to said bell port opening; and wherein, said bell port opening comprises at least one bell port opening reflective surface and said at least one bell port opening reflective surface is arranged relative to said side wall to reflect sound in a side propagation path from said at least one bell port opening to said side wall and from said side wall to ambient; and comprising, at least two side walls and two bell ports with respective bell port openings to ambient;

and wherein, each respective said bell port opening includes comprises at least one bell port opening reflective surface and each said at least one bell port opening reflective surface is arranged relative to a respective side wall to reflect sound in a side propagation path from said at least one bell port opening to said respective side wall and from respective said side wall to ambient.

22. A speaker enclosure venturi expander, comprising, a speaker enclosure having a front wall, rear wall, and a side wall, respectively;

a speaker having a speaker front and a speaker rear;

said speaker mounted in said front wail of said speaker enclosure with said speaker front opening to ambient and said speaker rear inside said enclosure;

at least one bell port, with a bell port inlet opposed to said speaker rear, and with bell port opening to ambient; and a plurality of sound reflecting surfaces in said bell port placed with at least two of said sound reflecting surfaces arranged relative to each other and to said bell port inlet, to reflect sound in a plurality of oblique sound propagation paths from said bell port inlet to said bell port opening, and wherein said rear wall comprises a sound port opening from said speaker enclosure to said bell port and at least two of said bell port sound reflecting surfaces are placed opposed to said rear wall to reflect sound from said sound port to said rear wall or to receive sound reflected from said rear wall.

23. The speaker enclosure venturi expander of claim 22, wherein at least two of said sound reflecting surfaces are stepped relative to each other to increase the length of at least one of said oblique sound propagation paths for one respective stepped reflective surface relative to the length of another of said oblique sound propagation paths for another of said respective stepped reflective surfaces.

24. The speaker enclosure of claim 23, wherein said bell port inlet, said bell port opening and said sound reflecting surfaces, comprise a direct propagation path from said bell port inlet to said bell port opening and wherein said plurality of oblique sound propagation paths, cross said direct propagation path.

25. A speaker enclosure venturi expander, comprising, a speaker enclosure having a front wall, rear wall, and a side wall, respectively;

and with said rear wall joined to said side wall;

a speaker having a speaker front and a speaker rear;

said speaker mounted in said front wall of said speaker enclosure with said speaker front opening to ambient and said speaker rear inside said enclosure;

at least one bell port, with a bell port inlet opposed to said speaker rear, and with bell port opening to ambient;

a plurality of sound reflecting surfaces in said bell port placed with at least two of said sound reflecting surfaces arranged relative to each other and to said bell port inlet, to reflect Sound in a plurality of oblique sound propagation paths from said belt port inlet to said bell port opening;

said rear wall including a rear wall port opening between said speaker enclosure and said bell port; and said plurality of reflecting surfaces include said rear wall; and wherein said bell port is proximate said rear wall joined to said side wall; and wherein said bell port opening comprises at least one bell port opening reflective surface proximate said rear wall joined to said side wall; and said at least one bell port opening reflective surface is arranged relative to said side wall to reflect sound in a side propagation path from said at least one bell port opening to said side wall and from said side wall to ambient.

26. A speaker enclosure venturi expander, comprising, a speaker enclosure having a front wall, rear wall, and a side wall, respectively; and with said rear wall joined to said side wall;

a speaker having a speaker front and a speaker rear;

said speaker mounted in said front wall of said speaker enclosure with said speaker front opening to ambient and said speaker rear inside said enclosure;

at least one bell port, with a bell port inlet opposed to said speaker rear, and with bell port opening to ambient;

a plurality of sound reflecting surfaces in said bell port placed with at least two of said sound reflecting surfaces arranged relative to each other and to said bell port inlet, to reflect sound in a plurality of oblique sound propagation paths from said bell port inlet to said bell port opening;

said rear wall including a rear wall port opening between said speaker enclosure and said bell port; and said plurality of reflecting surfaces include said rear wall; and wherein said bell port is proximate said rear wall joined to said side wall, and comprising at least two side walls and two bell ports opposed to said speaker rear with respective bell port openings to ambient; and wherein, each respective said bell port opening comprises at least one bell port opening reflective surface and said at least one bell port opening reflective surface is arranged relative to a respective side wall to reflect sound in a side propagation path from said at least one bell port opening to said respective side wall and from respective said side wall to ambient.

27. The speaker enclosure of claim 25, wherein said bell port inlet, said sound reflecting surfaces and said bell port opening include a direct sound propagation path from said bell port inlet to said bell port opening and wherein said plurality of oblique sound propagation paths, cross said direct propagation path.

28. The speaker enclosure of claim 25, wherein said speaker enclosure comprises a top wall or bottom wall and wherein said at least one bell port opening reflective surface is arranged relative to said top wall or said bottom wall to reflect sound in a side propagation path from said at least one bell port opening to said top wall or said bottom wall, to ambient.

29. A speaker enclosure comprising, a front wall means, a side wall means and a rear wall means;

a speaker means for propagating sound in a forward propagation path from said front wall means and in a rear propagation path into said speaker enclosure;

a bell port means, including bell port opening means and bell port receiving means for receiving said sound from said speaker means in said rear propagation path and for directing said sound in a plurality of oblique sound propagation paths in opposed directions relative to each other, to said bell port opening means; and wherein said bell port means, said bell port inlet means and said bell port opening means comprises a direct sound propagation path means from said bell port inlet means to said bell port opening means; and wherein said means for directing said sound in a plurality of oblique sound propagation paths in opposed directions relative to each other comprises means for directing said sound in a sound propagation path crossing said direct sound propagation path and said bell port means includes said rear wall means; and wherein said bell port opening means includes means for directing sound to ambient from said wall means and obliquely to said forward propagation path.

* * * * *